US005476432A

United States Patent [19]

Dickens

[11] Patent Number: 5,476,432

[45] Date of Patent: Dec. 19, 1995

[54] MEDICAL STROLLER

[76] Inventor: Robert Dickens, 1842 Arden Dr., Lincolnton, N.C. 28092

[21] Appl. No.: 166,556

[22] Filed: Dec. 14, 1993

[51] Int. Cl.[6] ..... A63B 22/00; A61H 3/00

[52] U.S. Cl. ..... 482/67; 135/67

[58] Field of Search ..... 482/66, 67, 68, 482/69, 148, 51; 135/67, 65, 66, 74

[56] References Cited

U.S. PATENT DOCUMENTS

| | | | |
|---|---|---|---|
| 4,272,071 | 6/1981 | Bolton | 482/67 |
| 4,342,465 | 8/1982 | Stillings | 482/68 |
| 4,387,891 | 6/1983 | Knochel | 482/68 |
| 4,953,851 | 9/1990 | Sherlock et al. | 482/66 |
| 5,255,697 | 10/1993 | Grauer | 482/66 |

*Primary Examiner*—Stephen R. Crow
*Attorney, Agent, or Firm*—W. Thad Adams, III

[57] ABSTRACT

A medical stroller includes a patient support frame having a first pair of curved patient support rails. A pivot pin and end plate pivotally join a respective proximal end of one of the patient support rails to a proximal end of the other of the patient support rails, and permits movement of the patient support rails between a closed, patient encircling support position and an open, patient ingress/egress position. First and second leg frames are attached to the patient support frame for vertically spacing the patient support rails above a supporting surface, and positioning the patient support rails generally in the region of between the waist and upper torso of the patient. Caster wheels are carried by the first and second leg frames for permitting rolling movement of the stroller.

7 Claims, 7 Drawing Sheets

MEDICAL STROLLER

TECHNICAL FIELD AND BACKGROUND OF THE INVENTION

This invention relates to a medical stroller for assisting those who have difficulty walking about on their own due to old age, or various physical limitations. The invention is easy to maneuver, and includes safety features for preventing the patient from falling to the ground and injuring himself.

Prior art walking aids suffer from numerous drawbacks and limitations. The standard crutch or forearm crutch is insufficient for the relatively weak patient who is unable to adequately support his body weight through the arms for an extended period of time. Further, the use of crutches may increase the potential for accidents and injury to the patient, particularly where the patient's physical abilities are steadily declining. The four-legged walker includes similar limitations. Although the walker provides more support, as compared to crutches, the potential for accidents and injury is evident. Typical walkers do not include a safety harness which will catch the patient in the event of a fall. Moreover, the walker requires a relatively high amount of strength and mobility to maneuver, as compared to the present invention. The wheelchair is often the last resort for the patient who is incapable of safely walking or moving about with these such prior art walking aids. Since the wheelchair provides no exercise or movement for legs, these muscles will atrophy more quickly and ultimately diminish the physical strength of the patient.

The present invention addresses the problems of prior art walking aids by providing a medical stroller which is safe and easy to maneuver. The present invention allows the patient to use the muscles in the arms and legs when walking without any danger of falling. In addition, the present invention is moveable from an open patient ingress/egress position to a closed patient encircling position. This allows the patient to easily enter and exit the stroller in the open position, while providing complete patient support in the closed position.

SUMMARY OF THE INVENTION

Therefore, it is an object of the invention to provide a medical stroller which is both safe and relatively easy to maneuver.

It is another object of the invention to provide a medical stroller which will completely support the weight of the patient, and prevent the patient from falling to the ground in the event of an accident or medical emergency.

It is another object of the invention to provide a medical stroller which includes a patient support frame which pivots to an open position to provide the care-giver with relatively easy and convenient means for comfortably positioning the patient in the medical stroller.

It is another object of the invention to provide a medical stroller which includes a patient support frame extending completely around the torso area of the patient for providing support to the patient when the medical stroller is in a closed position.

It is another object of the invention to provide a medical stroller including a patient support frame which is moveable to an open position for permitting the patient to easily enter and exit the medical stroller.

It is another object of the invention to provide a medical stroller which includes three or more legs each having a wheel located at a respective free end for providing rolling movement of the medical stroller along a supporting surface.

It is another object of the invention to provide a medical stroller which includes a seat harness suspended from the patient support frame which acts to catch and support the patient in the event of a fall.

It is another object of the invention to provide a medical stroller which is relatively inexpensive to manufacture, and relatively easy to construct.

These and other objects of the present invention are achieved in the preferred embodiments disclosed below by providing a medical stroller. The medical stroller includes a patient support frame having a first pair of curved patient support rails. Pivot means pivotally joins a respective proximal end of one of the patient support rails to a proximal end of the other of the patient support rails, and permits movement of the patient support rails between a closed, patient encircling support position and an open, patient ingress/egress position. First and second leg frames are attached to the patient support frame for vertically spacing the patient support rails above a supporting surface, and positioning the patient support rails generally in the region between the waist and upper torso of the patient. Wheel means are carried by the first and second leg frames for permitting rolling movement of the stroller.

According to one preferred embodiment of the invention, the patient support frame further includes a second pair of patient support rails. The second pair of patient support rails are vertically spaced-apart from the first pair of patient support rails, and are connected to the first pair of patient support rails by respective pairs of front and back hollow standards. The second pair of rails are located below the first pair of rails for respectively engaging the first and second leg frames.

According to another preferred embodiment of the invention, the pivot means includes a removable pivot pin and end plate. The end plate is connected to a one of the front standards at a top end thereof, and extends over a top end of the other of the front standards. The end plate has a hole formed therein for permitting the pivot pin to be inserted therethrough within the hollow body of the other of the front standards. The pivot pin and the end plate cooperate to permit pivoting movement of the patient support frame from the open and closed positions.

According to yet another preferred embodiment of the invention, locking means is associated with the back pair of hollow standards for releasably locking the patient support frame in the closed position.

Preferably, the locking means includes first and second locking straps attached, respectively, to the first and second back vertical standards. The first strap has a plurality of hook members located on an inner surface thereof, and the second strap has a plurality of complementary loop members located on an outer surface thereof. The first and second straps are locked together by mating the hook members of the first strap with the loop members of the second strap.

According to yet another preferred embodiment of the invention, a fabric seat harness is suspended from the patient support frame for being positioned between the legs of the patient to support the patient in a seated position.

According to yet another preferred embodiment of the invention, an adjustable saddle seat is attached to the patient support frame for being located near the seat of the patient to support the patient in the seated position.

According to yet another preferred embodiment of the invention, each of the first and second leg frames includes a horizontal bar connected to a one of the rails of the second pair of patient support rails. First and second hollow legs are integrally formed with respective ends of the horizontal bar, and extend downwardly from the horizontal bar to the supporting surface. Each of the hollow legs carries respective wheel means for permitting rolling movement of the stroller.

According to yet another preferred embodiment of the invention, each of the hollow legs includes a telescoping member for permitting vertical adjustment of the patient support frame within the region of between the waist and upper torso of the patient.

According to yet another preferred embodiment of the invention, the wheel means include caster wheels.

According to yet another preferred embodiment of the invention, a torso plate is attached to the first pair of patient support rails and extends downwardly to the second pair of patient support rails. The torso plate has an inflatable air bladder attached thereto on an inside surface thereof for surrounding and supporting the upper torso area of the patient when the patient support frame is in the closed position.

According to yet another preferred embodiment of the invention, one rail of the first pair of rails includes an upwardly extending bar attached thereto for holding a medical IV bag in an elevated position generally above the chest of the patient.

According to yet another preferred embodiment of the invention, a pulse medication dispenser is attached to the leg of a one of the leg frames.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
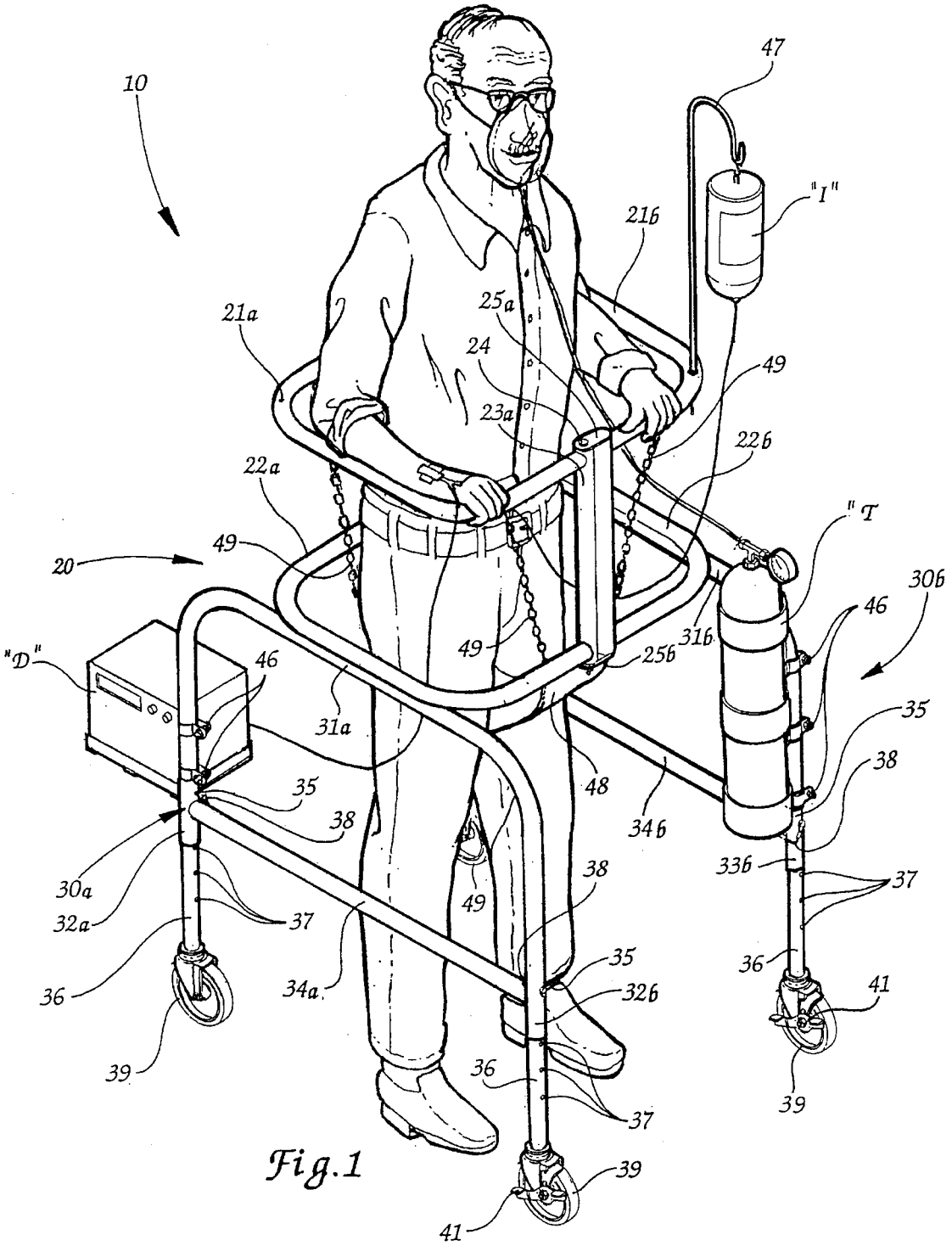
FIG. 1 is a perspective view of the medical stroller and patient, including various medical accessories attached the patient support frame and leg frames of the medical stroller.

Referring now specifically to the drawings, a medical stroller according to the present invention is illustrated in FIG. 1 and shown generally at reference numeral 10. The medical stroller 10 is intended to provide safe and easy means for assisting those who have difficulty walking about on their own. In addition, the medical stroller is useful for persons of all ages, and is adjustable to accommodate the particular size and body frame of the patient.

According to one embodiment, the medical stroller 10 is constructed of 1.5 inch diameter stainless steel piping, and is capable of supporting about 2,000 lbs. of weight. Preferably, the steel piping includes a chemical-free powder coating on its outer surface for providing resistance to electrical conductivity. In alternative embodiments, the medical stroller 10 may be constructed of PVC plastic or aluminum.

Figure 2:
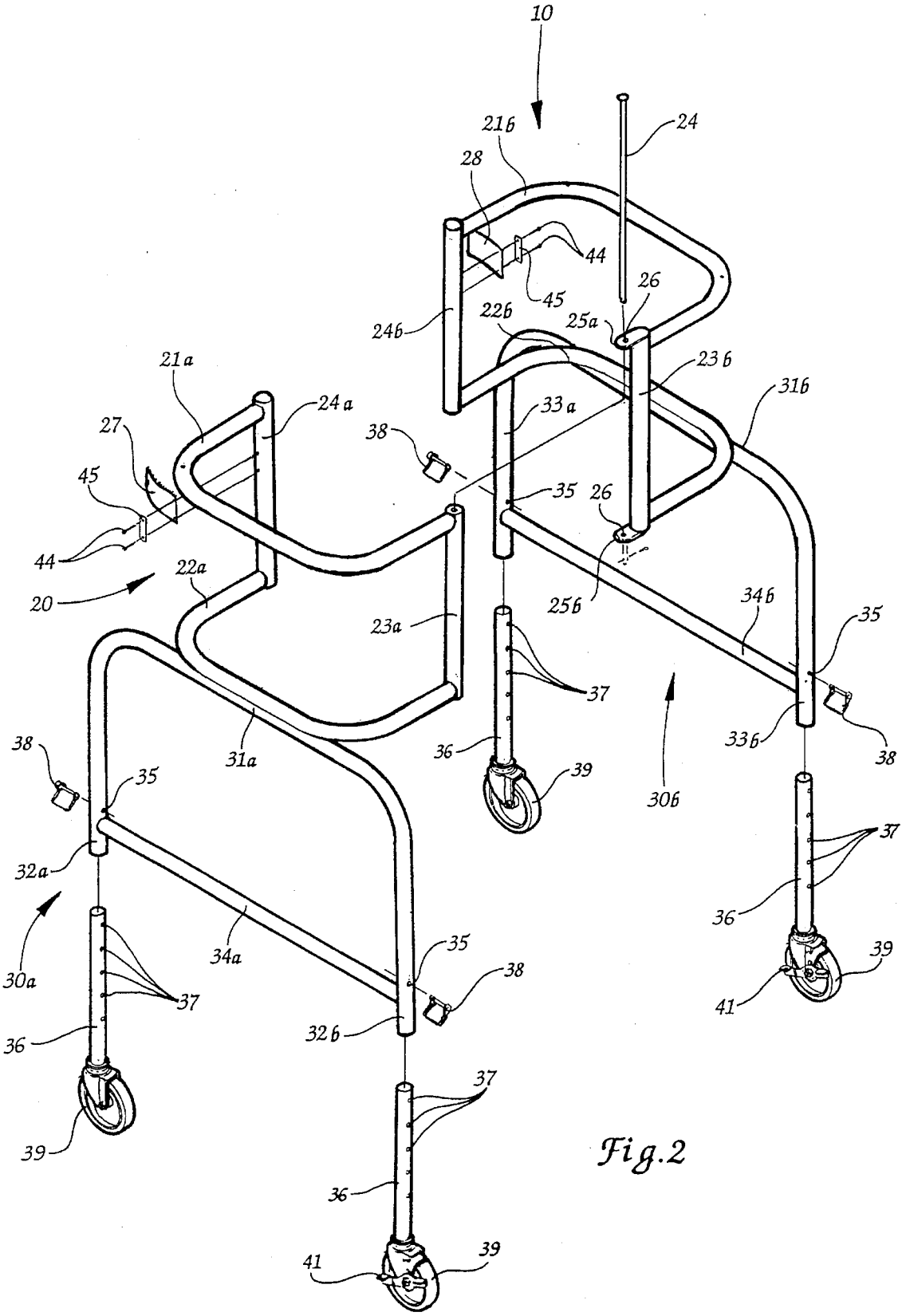
FIG. 2 is an exploded perspective view of the medical stroller showing particularly the respective halves of the patient support frame.

As best shown in FIGS. 1 and 2, the medical stroller 10 is formed of a patient support frame 20 including first and second pairs of curved patient support rails 21*a,b* and 22*a,b*, and first and second leg frames 30 and 40 for vertically spacing the patient support rails 21*a,b* and 22*a,b* above a supporting surface. The leg frames 30 and 40 of the medical stroller 10 are attached respectively to the second pair of patient support rails 22*a,b*, and function to position the patient support rails 21*a,b* and 22*a,b* in the region of between the waist and upper torso of the patient.

Preferably, each leg frame 30*a* and 30*b* includes a horizontal bar 31*a,b*, and first and second hollow legs 32*a,b* and 33*a,b*. The hollow legs 32*a,b* and 33*a,b* are integrally formed with respective ends of the horizontal bars 31*a,b*, and extend downwardly from the horizontal bars 31*a,b* towards the ground. A cross bar 34*a,b* is preferably connected to an inside portion of the first and second legs 32*a,b* and 33*a,b* to provide additional support and stability to the leg frame 30*a,b*. In addition, each of the legs 32*a,b* and 33*a,b* of the respective leg frames 30*a,b* has a small hole 35 formed therethrough slightly above the connecting end of the crossbar 34*a,b* for use in adjusting the height of the leg frame 30*a,b*.

The height of the respective leg frames 30*a,b* is adjustable to raise or lower the position of the patient support rails 21*a,b* and 22*a,b* along the length of the body of the patient. To adjust the height, a hollow telescoping member 36 having a diameter slightly smaller than the diameter of the legs 32*a,b* and 33*a,b* is inserted within the hollow body of each of the legs 32*a,b* and 33*a,b*. The telescoping member 36 has several vertically-spaced holes 37 formed therethrough for being aligned, respectively, with the small hole 35 formed through each of the hollow legs 32*a,b* and 33*a,b*. Once aligned, a holding pin 38 is passed through the hole 37 in each of the telescoping members 36 and legs 32*a,b* and 33*a,b* to prevent the telescoping members 36 from slipping or moving within the length of the hollow legs 32*a,b* and 33*a,b*.

Preferably, caster wheels 39 are mounted at respective free ends of the telescoping members 36 to provide rolling movement of the medical stroller 10 along the ground or supporting surface. According to one preferred embodiment, two or more of the caster wheels 39 include locks 41 to prevent rotation of the wheels 39 and movement of the stroller 10 as the patient enters and exits the stroller 10.

As best shown in FIGS. 1 and 2, the patient support frame 20 is mounted on a top portion of the horizontal bar 31*a,b* of each of the leg frames 30*a,b*, and is moveable from a closed, patient encircling position to an open, patient ingress/egress position. The first and second pairs of patient support rails 21*a,b* and 22*a,b* of the patient support frame 20 are connected together and vertically spaced-apart by front and back pairs of hollow vertical standards 23*a,b* and 24*a,b*.

Preferably, the first and second front standards 23*a* and 23*b* of the patient support frame 20 are pivotally connected together by a pivot pin 24 and top and bottom end plates 25*a,b*. The end plates 25*a,b* are connected, respectively, to the top and bottom ends of the second front standard 23*b*, and extend laterally over the top and bottom ends of the adjacent first front standard 23*a*. The respective portions of the top and bottom end plates 25*a,b* extending over the first front standard 23*a* include a small opening 26 for receiving the pivot pin 24. Thus, the pivot pin 24 extends through the opening 26 in the top end plate 25*a* downwardly within the hollow body of the first front standard 23*a*, and out through the opening 26 in the bottom end plate 25*b*. The pivot pin 24 and end plates 25*a,b* cooperate to permit pivoting movement of the first and second pairs of patient support rails 21*a,b* and 22*a,b* about the pivot pin 24 of the front hollow vertical standards 23*a,b*.

Figure 3:
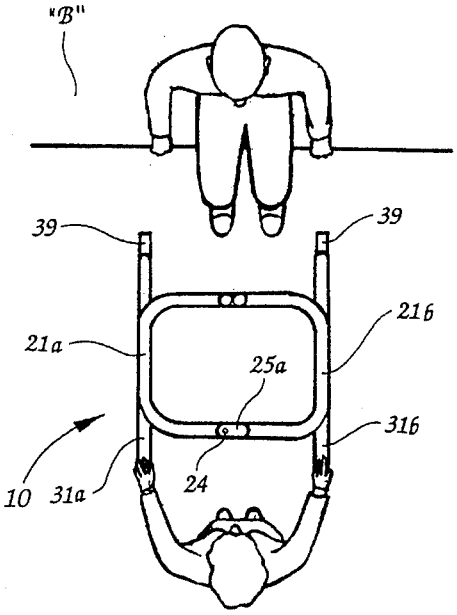
FIG. 3 is a top plan view of the medical stroller in the closed position prior to the patient entering the patient support frame.
Figure 4:
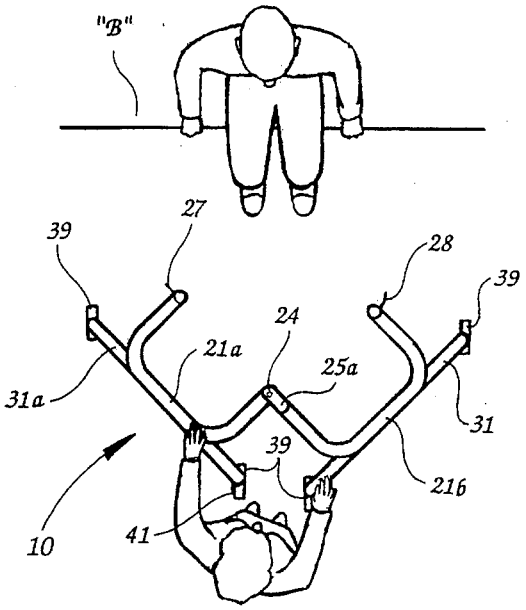
FIG. 4 is a top plan view of the medical stroller in the open position just prior to the patient entering the patient support frame.
Figure 5:
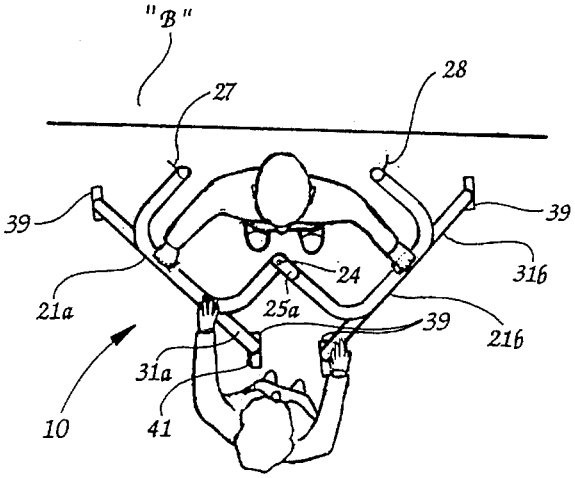
FIG. 5 is a top plan view of the medical stroller in the open position just subsequent to the patient entering the patient support frame.
Figure 6:
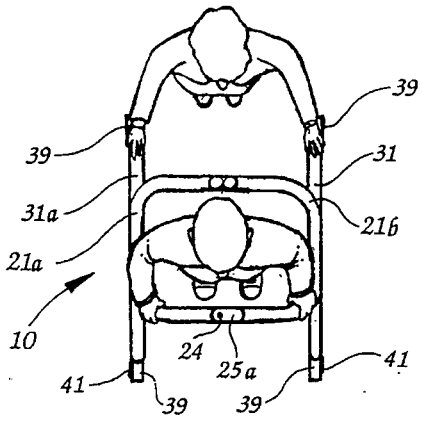
FIG. 6 is a top plan view of the medical stroller in the closed position subsequent to the patient entering the patient support frame.

FIGS. 3–6 illustrate the pivoting movement of the patient support frame 20 from the closed patient encircling position to the open patient ingress/egress position. As shown in FIG. 3, the medical stroller 10 is first guided to the bed "B" of the patient by a nurse or other hospital staff. The nurse then moves the patient support frame 20 to the open, patient ingress/egress position by pivoting the patient support rails 21*a,b* and 22*a,b* about the pivot pin 24 of the front vertical standards 23*a,b*, as shown in FIG. 4. At this point, the nurse may lock the two front caster wheels 39 to prevent the medical stroller 10 from moving away from the bed "B" as the patient enters the patient support frame 20. FIG. 5 shows the position of the patient immediately after entering the medical stroller 10 with the patient support frame 20 in the open position. Once the patient has entered the medical stroller 10 and is comfortably supported by the use of the first pair of patient support rails 21*a,b*, the nurse will secure the patient within the medical stroller 10 by pivoting the patient support frame 20 back to the closed patient encircling position. If further assistance is necessary, the nurse may move to the back of medical stroller 10, behind the patient, to help the patient maneuver the medical stroller 10 along the supporting surface (See FIG. 6).

Figure 7:
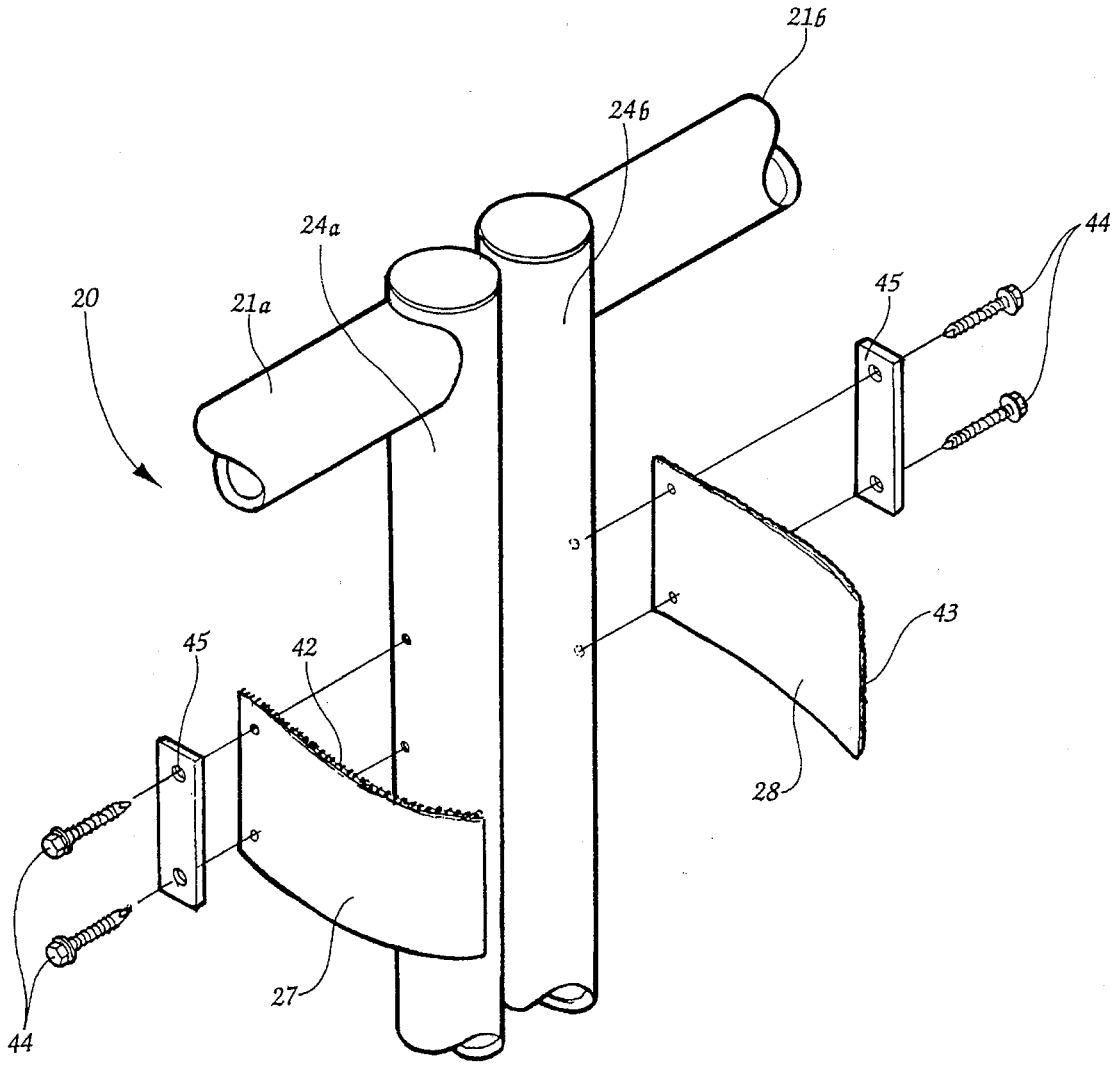
FIG. 7 is a fragmentary perspective view of the first patient support rails and the back vertical standards, showing particularly the locking means for securing the patient support frame in the closed position.

Referring to FIG. 7, the patient support frame 20 may be secured or locked in the closed position by first and second locking straps 27 and 28 to prevent the patient from exiting the stroller 10 without proper assistance or guidance. The locking straps 27 and 28 are located, respectively, on the back pair of vertical standards 24*a,b*. The first locking strap 27 has a number of hook members 42 located on an inner surface, while the second locking strap 28 includes a number of complementary loop members 43 located on an outer surface. By mating the hook members 42 of the first locking strap 27 with the loop members 43 of the second locking strap 28, the locking straps 27 and 28 are connected together to secure the patient support frame 20 in the closed position. Preferably, each locking strap 27 and 28 is attached to the respective back standards 24*a,b* by metal screws 44 and a washer plate 45.

Figure 8:
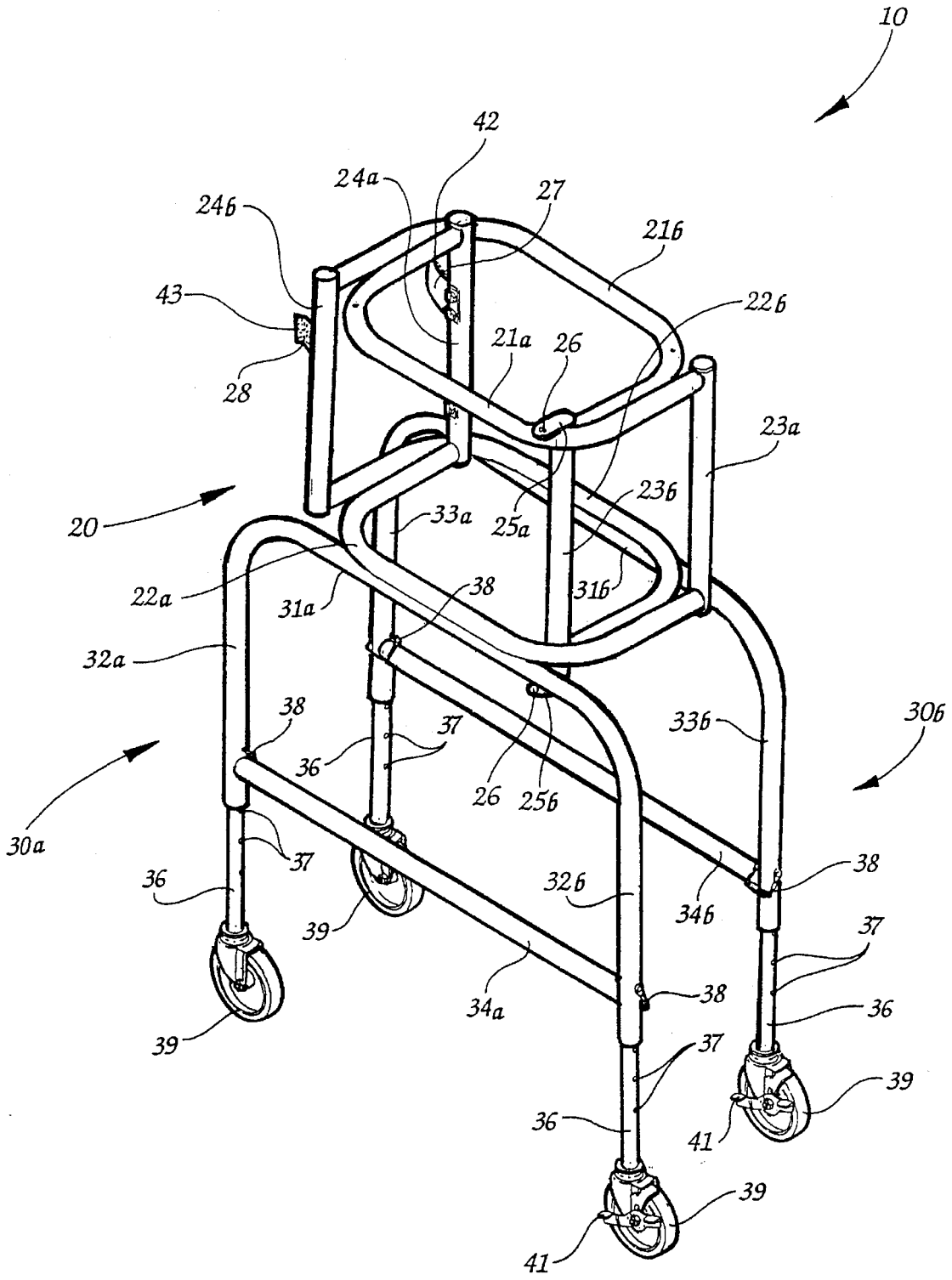
FIG. 8 is a perspective view of the medical stroller in the collapsed position for being transported in the trunk or back seat of a vehicle.

As shown in FIG. 8, the medical stroller 10 may be collapsed for allowing convenient transport of the medical stroller 10 in the trunk or back seat of a vehicle. By removing the pivot pin 24 from the front vertical standards 23*a,b* and releasing the locking straps 27 and 28 of the back vertical standards 24*a,b*, the medical stroller 10 is easily separable into two halves.

Referring again to FIG. 1, the medical stroller 10 may provide for the attachment of various accessories, such as a pulse medication dispenser "D" IV bag "I" and oxygen tank "T". The convenient access and easy attachment of these items may be essential for some patients for supplying necessary medical treatment or care. The pulse medication dispenser "D" and oxygen tank "T" are preferably located on the inside of the respective leg frames 30*a,b*, and are attached to the leg frames 30*a,b* by several bracket fasteners 46. The IV bag "I" may be suspended from a bar 47 attached to the first pair of patient support rails 21*a,b*, and extending upwardly from the patient support frame 20 to an elevated position generally above the chest of the patient.

In addition, the medical stroller 10 may include a washable canvas seat harness 48 suspended from the first pair of patient support rails 21*a,b* of the patient support frame 20. Preferably, the seat harness 48 is attached at respective corners thereof to the patient support rails 21*a,b* by stainless steel chains 49. A removable S-hook (not shown) serves to removably attach the respective free ends of each of the chains 49 to respective loops (not shown) formed on the underside portion of the patient support rails 21*a,b* of the patient support frame 20. As shown in FIG. 1, the fabric seat harness 48 is intended for being positioned between the legs of the patient to support the patient in a seated position for resting, or to prevent the patient from falling to the ground in the event of an accident. For added comfort, the seat harness 48 may include foam padding. In addition, the seat harness 48 may be covered with a leak-proof, disposable plastic liner.

Figure 9:
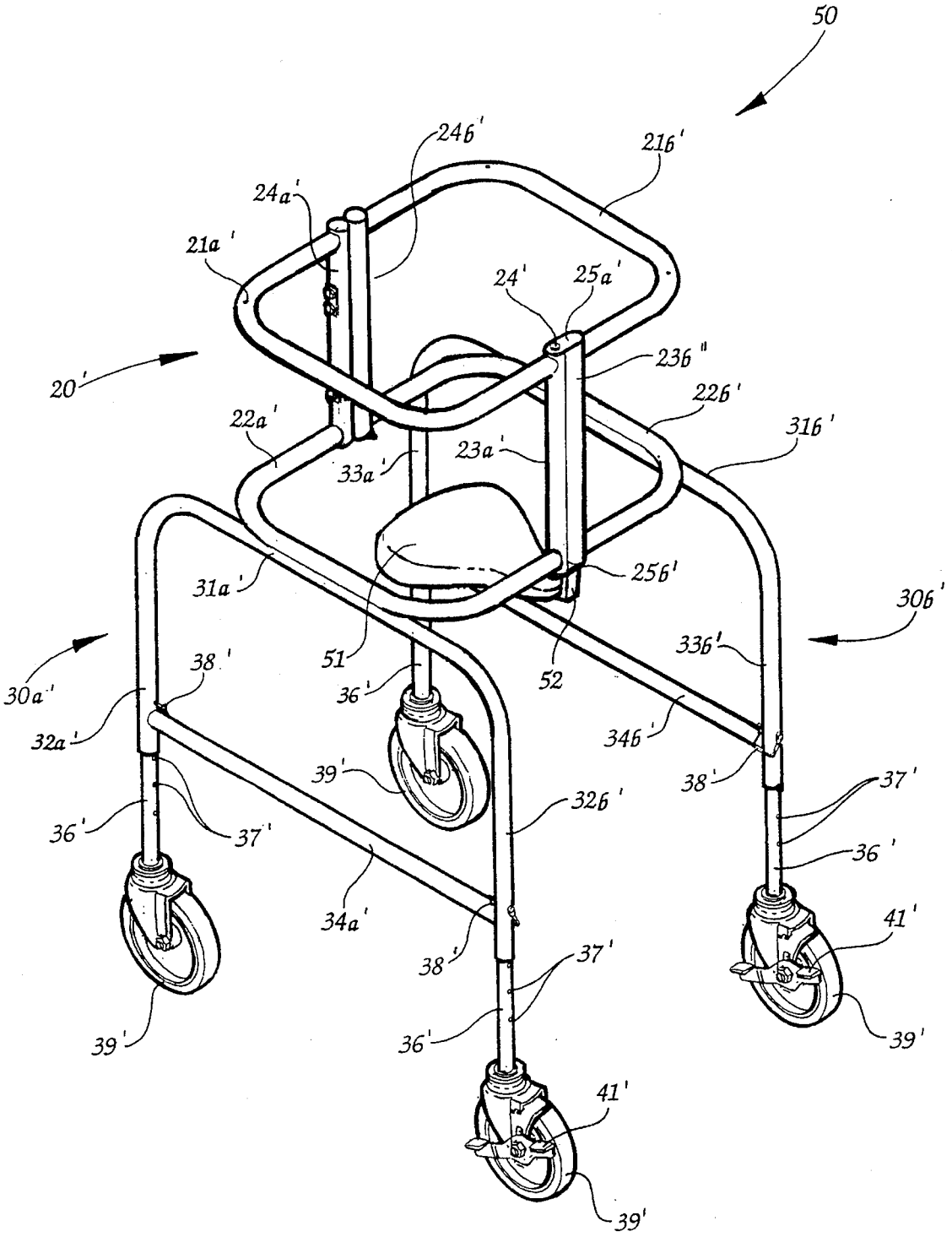
FIG. 9 is a perspective view of the medical stroller according to a second embodiment including a saddle seat attached to the patient support frame.

A second embodiment of the medical stroller 50 is illustrated in FIG. 9. Like elements shown in FIG. 9 and described in detail above are referenced in prime notation. The medical stroller 50 includes an adjustable saddle seat 51 or bicycle-type seat connected to a one of the front vertical standards 23*a',b'* by a connecting bar 52 extending along the length of an inside portion of the front vertical standard, and attached to the front vertical standard by welding or other suitable connection. Preferably, the connecting bar 52 includes a telescoping portion and holding pin (not shown) for permitting height adjustment of the seat 51 in a similar manner described above with reference to the legs 32*a',b'* and 33*a',b'* of the leg frames 30*a',b'*. The medical stroller 50 is particularly suited for younger patients, but may be used by those who have difficulty supporting their body weight with the arms.

Figure 10:
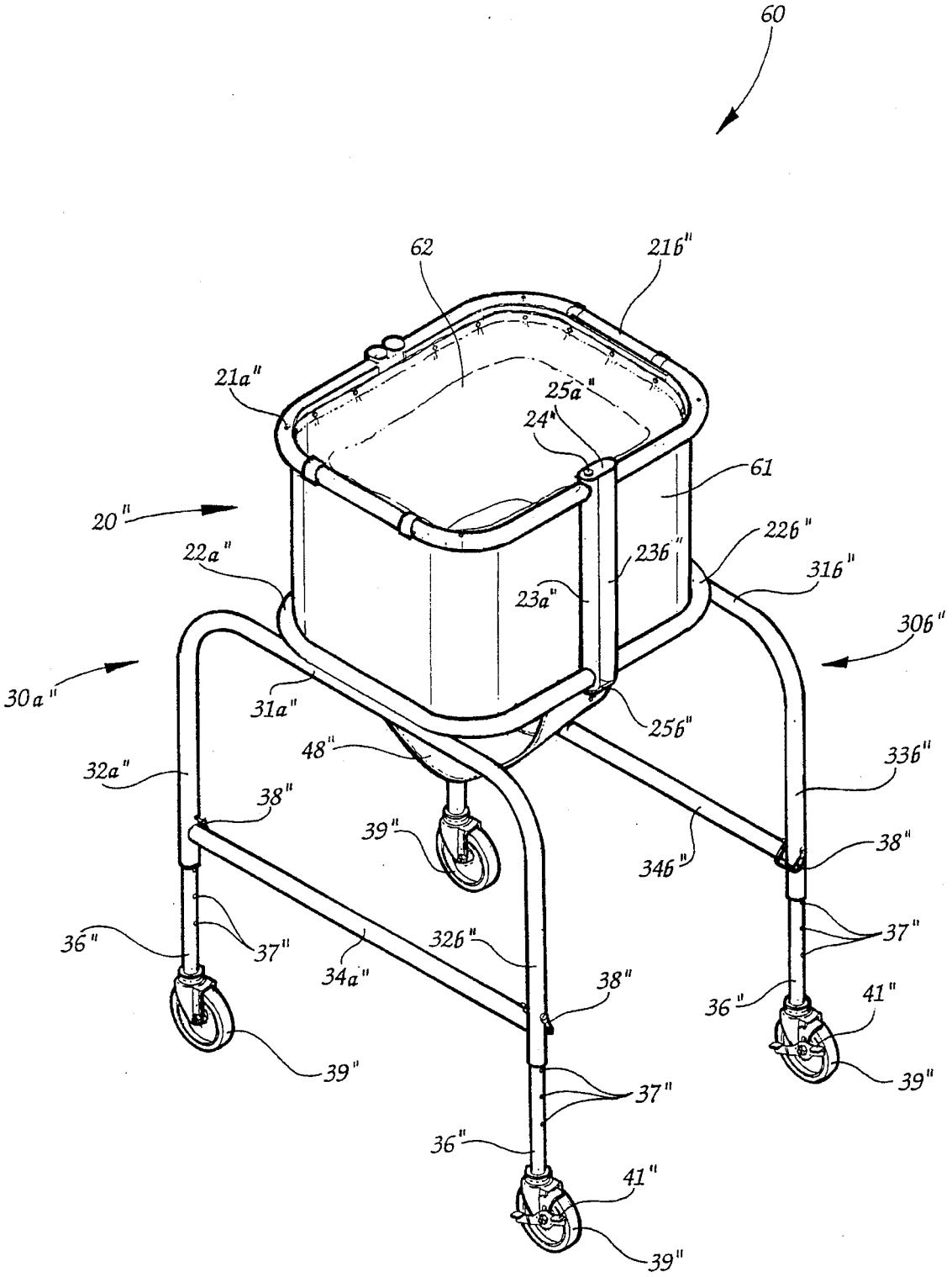
FIG. 10 is a perspective view of the medical stroller according to a third embodiment including a torso plate and air bladder.

According to a third embodiment shown in FIG. 10, the medical stroller 60 includes a torso plate 61 and inflatable air bladder 62. Like elements shown in FIG. 10 and described in detail above are referenced in double prime notation. The torso plate 61 is attached to the first pair of patient support rails 21*a",b"* and extends downwardly to the second pair of patient support rails 22*a",b"*. Preferably, the torso plate 61 is constructed of a rigid material such as PVC plastic or aluminum, and is spring clipped to the top inside portion of the first pair of patient support rails 21*a",b"*.

The inflatable air bladder 62 is attached to an inside surface of the torso plate 61 for surrounding and supporting the upper torso area of the patient when the patient support frame 20" is in the closed patient encircling position. The air bladder 62 may be inflated by means of an air line or hose (not shown) removably attached to the air bladder and communicating with a small, portable air tank. The torso plate 61 and air bladder 62 are especially desirable for those who have had recent heart surgery or other similar operation where the torso area was cut open by the surgeon. The air bladder 62 allows the torso plate 61 to closely conform to the contours of the torso to cushion the fragile areas of the torso. This will help support the patient and prevent tearing or other damage to the stitched portion of the body.

A medical stroller is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A medical stroller, comprising:

(a) a patient support frame;

(b) said patient support frame comprising first and second pairs of curved patient support rails, the second pair of patient support rails being vertically spaced-apart from and located beneath said first pair of patient support rails and connected to said first pair of patient support rails by respective pairs of front and back hollow vertical standards;

(c) pivot means pivotally joining together respective proximal ends of said first and second pairs of patient support rails, and permitting movement of the patient support frame between a closed, patient encircling support position and an open, patient ingress/egress position, said pivot means comprising a removable pivot pin and end plate, said end plate being connected to a one of said front vertical standards at a top end thereof and extending over a top end of the other of said front vertical standards, and said end plate having a hole formed therein for permitting said pivot pin to be inserted therethrough within the hollow body of the other of said front vertical standards, whereby said pivot pin and said end plate cooperate to permit pivoting movement of said patient support frame from the open and closed positions;

(d) first and second leg frames attached to said patient support frame and engaging the second pair of patient support rails for vertically spacing the patient support frame above a supporting surface, and positioning the first pair of patient support rails generally in the region between the waist and upper torso of the patient; and (e) wheel means carried by said first and second leg frames for permitting rolling movement of the stroller.

2. A medical stroller according to claim 1, further comprising locking means associated with the back pair of hollow vertical standards for releasably locking said patient support frame in the closed position.

3. A medical stroller according to claim 2, wherein said locking means comprises first and second locking straps attached, respectively, to the first and second back vertical standards, said first strap having a plurality of hook members located on an inner surface thereof and said second strap having a plurality of complementary loop members located on an outer surface thereof, whereby said first and second straps are locked together by mating the hook members of the first strap with the loop members of the second strap.

4. A medical stroller according to claim 1, further comprising a fabric seat harness suspended from said patient support frame for being positioned between the legs of the patient to support the patient in a seated position.

5. A medical stroller according to claim 1, wherein each of the first and second leg frames comprises a horizontal bar connected to a one of the rails of the second pair of patient support rails, and first and second hollow legs integrally formed with respective ends of said horizontal bar and extending downwardly from said horizontal bar to the supporting surface, each of said hollow legs carrying respective wheel means for permitting rolling movement of said stroller.

6. A medical stroller according to claim 5, wherein each of said hollow legs includes a telescoping member for permitting vertical adjustment of said patient support frame within the region of between the waist and upper torso of the patient.

7. A medical stroller according to claim 6, wherein said wheel means comprises caster wheels.

* * * * *